United States Patent [19]

Wakita et al.

[11] 4,202,173

[45] May 13, 1980

[54] SECONDARY AIR SUPPLYING DEVICE OF AN INTERNAL COMBUSTION ENGINE

[75] Inventors: Nobuaki Wakita; Kohei Igarashi, both of Susono, Japan

[73] Assignee: Toyota Jidosha Kogyo Kabushiki Kaisha, Toyota, Japan

[21] Appl. No.: 913,885

[22] Filed: Jun. 8, 1978

[30] Foreign Application Priority Data

Mar. 22, 1978 [JP] Japan ..... 53-31686

[51] Int. Cl.[2] ..... F01N 3/10

[52] U.S. Cl. ..... 60/290; 60/306

[58] Field of Search ..... 60/289, 290, 306

[56] References Cited

U.S. PATENT DOCUMENTS 3,906,723 9/1975 Matumoto ..... 60/290

3,962,868 6/1976 Matumoto ..... 60/290

FOREIGN PATENT DOCUMENTS 52-46576 11/1977 Japan ..... 60/290

*Primary Examiner*—Douglas Hart

*Attorney, Agent, or Firm*—Stevens, Davis, Miller & Mosher

[57] ABSTRACT

Disclosed is a secondary air supplying device of an internal combustion engine having an exhaust passage provided with a catalyzer for purifying exhaust gas. The device includes a first air injection port provided in the exhaust passage at the upstream side of an exhaust manifold and a second air injection port provided in the exhaust passage at the upstream side of the catalyzer. Under the engine warming operating condition only when the engine speed is abruptly accelerated, or during a predetermined time interval after the engine is warmed, is secondary air injected into the exhaust passage from the second air injection port. When the engine is in the other operating conditions, secondary air is injected into the exhaust passage from the first air injection port.

1 Claim, 3 Drawing Figures

SECONDARY AIR SUPPLYING DEVICE OF AN INTERNAL COMBUSTION ENGINE

BACKGROUND OF THE INVENTION

The present invention relates to a secondary air supplying device of an internal combustion engine, and more particularly relates to such a device of an internal combustion engine having a catalytic convertor for purifying exhaust gas provided in an exhaust pipe.

In a conventional secondary air supplying device of an internal combustion engine, secondary air is generally injected into an exhaust port in a cylinder head at the downstream side of an exhaust valve, in other words, at the upstream side of an exhaust manifold. However, in such a conventional secondary air supplying device, there is a disadvantage that, when the secondary air is injected into the exhaust passage during a high speed engine operating condition, where the temperature of the exhaust gas is high, the catalytic convertor is overheated because the secondary air reacts with exhaust gas in the exhaust port and in the exhaust manifold, and the temperature of the exhaust gas is increased further. Particularly, if the engine has an exhaust reactor provided in the exhaust manifold, this disadvantage is more significant, because the reaction of the exhaust gas is promoted even more.

In order to overcome this disadvantage, there has been proposed a secondary air supplying device having a secondary air switching valve, by which the supply route of secondary air is changed so that the secondary air is supplied into the exhaust passage at the upstream side of the catalytic convertor after the engine is warmed, and the catalytic convertor is cooled by the secondary air. However, the secondary air switching valve used in such a secondary air supplying device is operated with vacuum pressure drawn from the intake manifold and, therefore, even after the engine is warmed, when the intake manifold vacuum pressure is reduced to a value lower than a predetermined value, secondary air is again supplied into the exhaust passage at the upstream side of the exhaust manifold. Generally speaking, as an exhaust reactor is provided in the exhaust manifold, the secondary air supplied at the upstream side of the manifold reacts with exhaust gas in the exhaust reactor and its temperature becomes high. As a result, the effect of preventing the catalytic convertor from overheating by the secondary air is not sufficiently attained and the purification effect of the exhaust gas by the catalytic convertor is not sufficiently attained.

SUMMARY OF THE INVENTION

The principal object of this invention is to provide a secondary air supplying device of an internal combustion engine, in which the supply route of the secondary air is changed so that the secondary air is supplied to an exhaust passage selectively at the upstream side of the exhaust manifold and at the upstream side of the catalytic convertor, and in which the supply route of the secondary air is effectively changed in accordance with the engine operating conditions, the overheating of the catalytic convertor is prevented and the effect of purification of exhaust gas by the catalytic convertor is improved.

According to the present invention, there is provided a secondary air supplying device of an internal combustion engine having an exhaust passage provided with a catalyzer for purifying exhaust gas passing therein, comprising: first air injection means having a first air injection port provided in said exhaust passage at the upstream side of an exhaust manifold of the engine; second air injection means having a second injection port provided in said exhaust passage at the upstream side of said catalyzer; an air pump for supplying secondary air; a first air changing means connected to said air pump and being adapted to release secondary air to the atmosphere when the engine is in a cooled operating condition and to supply secondary air to a second air changing means when the engine is in warming and warmed up operating conditions, and; said second air changing means being connected to said first air changing means and being adapted to selectively supply secondary air to one of said first and second air injection ports. Said second air changing means comprises an air switching valve constructed as a pneumatic valve having a diaphragm chamber, and said air changing valve supplies secondary air to the first air injection port when atmospheric air is introduced into said diaphragm chamber and supplies secondary air to the second air injection port when the vacuum pressure is introduced into said diaphragm chamber.

The diaphragm chamber of the secondary air switching valve may be communicated with the intake manifold by means of a first vacuum pressure passage and a second vaccum pressure passage positioned in parallel to each other. The first vacuum pressure passage is provided with a pressure delay valve and a vacuum pressure changing switch which is actuated in accordance with the temperature of engine cooling water. On the other hand, the second vacuum pressure passage is provided with a vacuum pressure introduction valve. During a warming operation of the engine, atmospheric pressure is transmitted to the diaphragm chamber from said vacuum pressure changing switch through the pressure delay valve, except that, when the intake manifold vacuum pressure is abruptly increased, such as when the engine is in an abrupt decelerating operating condition, the vacuum pressure is transmitted to the diaphragm chamber through said vacuum pressure introduction valve. On the other hand, after the engine is warmed up, the intake manifold vacuum pressure is transmitted to the diaphragm chamber through the pressure delay valve. However, during a predetermined time interval after the manifold vacuum pressure is abruptly reduced when the engine is in high load operating condition, the vacuum pressure is maintained in the diaphragm chamber.

The object of the present invention will be readily evident from the following description with reference to the accompanying drawings in which.

DETAILED DESCRIPTION OF A PREFERRED EMBODIMENT

Figure 1:
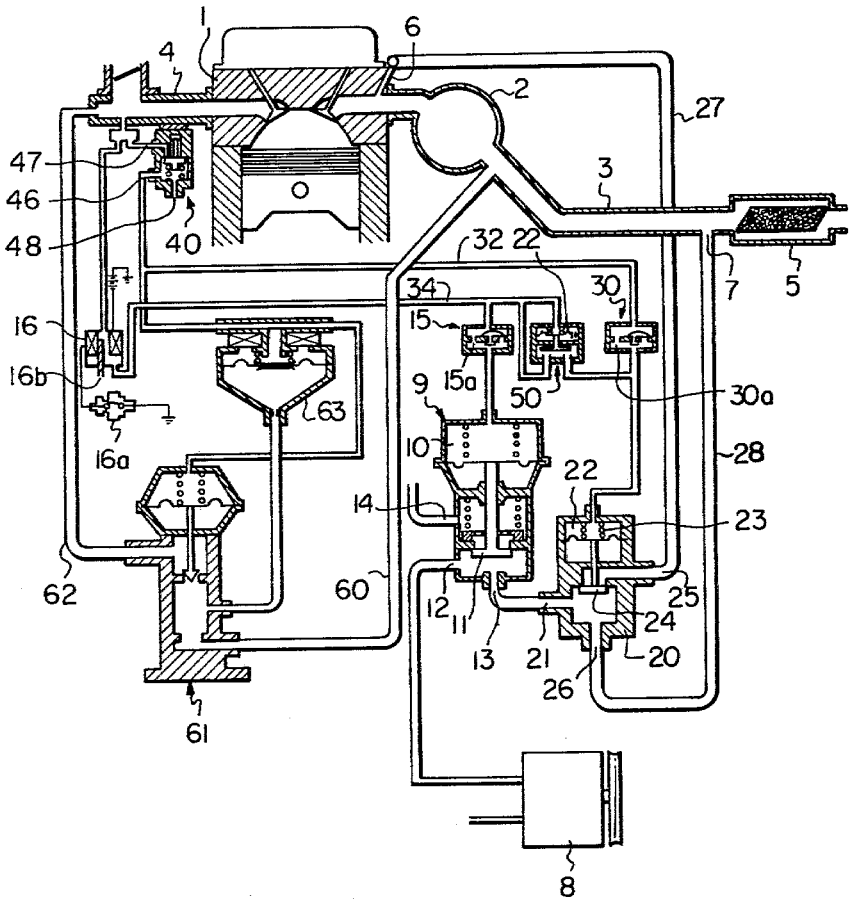
FIG. 1 is a schematic view of an embodiment of a secondary air supplying device of an internal combustion engine of this invention.

Referring now to the drawings, a secondary air supplying device of an internal combustion engine of this invention is schematically illustrated in FIG. 1. The engine comprises a main body of the engine, generally indicated by reference numeral 1, an exhaust manifold 2, an exhaust pipe 3 and an intake manifold 4. An exhaust reactor, not shown in the drawings, is provided in the exhaust manifold 2, in order to promote the reaction of CO, HC and the like contained in exhaust gas. This engine has a catalytic convertor 5 provided in the exhaust pipe 3 in order to purify exhaust gas flowing therein. A first air injection port 6 for supplying secondary air into the exhaust system is provided in the exhaust system at the upstream side of the exhaust manifold 2, and a second air injection port 7 for supplying secondary air into the exhaust system is provided in the exhaust pipe 3 at the upstream of the catalytic convertor 5. These first and second air injection ports 6 and 7 are connected to a second air switching valve 20, as described in detail hereinafter.

There is provided an air pump 8 which supplies secondary air into a first air switching valve 9. The first air switching valve 9 comprises a diaphragm chamber 10 and a valve element 11 which is actuated by vacuum pressure transmitted into the diaphragm chamber 10. The first air switching valve 9 is adaptable to be operated so that the supply of secondary air through an inlet port 12 thereof is selectively changed so that the secondary air is flowed to an outlet port 13 or to an outlet port 14. The diaphragm chamber 10 is connected to the intake manifold 4 through a pressure delay valve 15 and a solenoid valve 16. The outlet port 13 of the first air switching valve 9 is connected to an inlet port 21 of the second air switching valve 20, while the other outlet port 14 is open to the atmosphere.

The second air switching valve 20 comprises a diaphragm chamber 22, a spring 23 and a valve element 24 which is actuated by vacuum pressure transmitted into the diaphragm chamber 22. The second air switching valve 20 is adaptable to be operated so that supply route of secondary air through the inlet port 21 thereof is changed so that the secondary air is flowed selectively to an outlet port 25 or to an outlet port 26. The outlet port 25 of the second air switching valve 20 is connected to the first air injection port 6 through a secondary air passage 27, while the outlet port 26 thereof is connected to the second air injection port 7 through a secondary air passage 28.

The diaphragm chamber 22 of the second air switching valve 20 is connected to the intake manifold 4 by means of a first vacuum passage 32 having a pressure delay valve 30 and a vacuum changing switch 40 for changing the vacuum flow in accordance with the temperature of engine cooling water, and a second vacuum passage 34 provided parallel to the first vacuum passage 32 and having a vacuum pressure introduction valve 50 and the solenoid valve 16.

Figure 2:
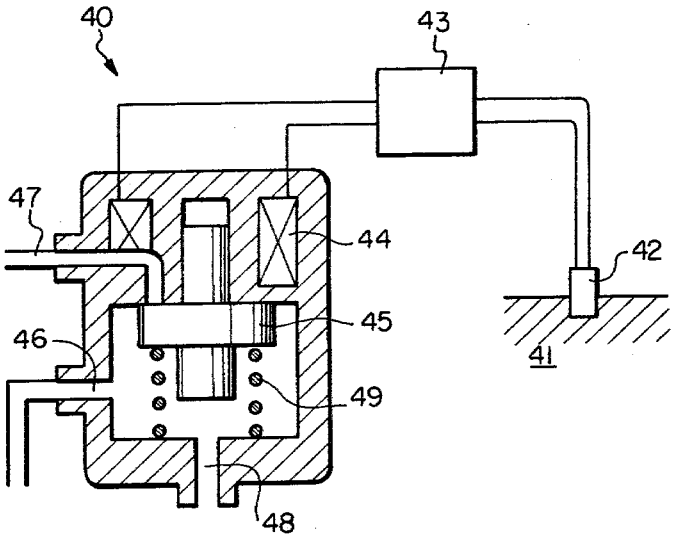
FIG. 2 is a cross-sectional view of a vacuum pressure switching valve which contains means for detecting the temperature of cooling water.

As illustrated in detail in FIG. 2, the vacuum changing switch 40, which contains means for detecting the temperature of engine cooling water, has a solenoid 44, into which the signal from a sensor 42 for detecting the temperature of engine cooling water 41 is input through an electric circuit 43, and a valve element 45 actuated by the solenoid 44 and operating as to communicate an outlet port 46 of the valve selectively with a vacuum introduction port 47 or with an atmospheric air introduction port 48.

Figure 3:
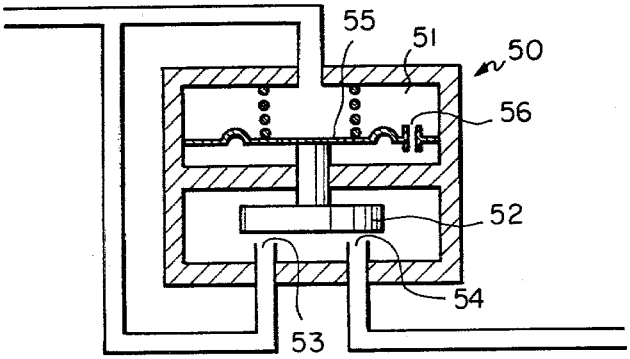
FIG. 3 is a cross-sectional view of a vacuum pressure introduction valve.

As illustrated in detail in FIG. 3, the vacuum introduction valve 50 has a diaphragm chamber 51 into which vacuum pressure is transmitted, and a valve element 52 actuated by vacuum pressure and operating as to communicate between a vacuum introduction port 53 and a vacuum outlet port 54 or interrupt the communication therebetween.

The secondary air supplying device of an internal combustion engine illustrated in FIG. 1 is also provided with an exhaust gas recirculation system, a so called EGR system, in which a part of exhaust gas is drawn from the exhaust passage and recirculated into the intake passage, in order to reduce the amount of $NO_x$ components contained in exhaust gas. A part of the exhaust gas is introduced from the exhaust pipe 3 through an EGR pipe 60 into an EGR control valve 61, in which the quantity of EGR gas is regulated, and then, return to the intake manifold 4 through a pipe 62. The EGR control valve 61 is actuated by vacuum pressure which is regulated in a vacuum control valve 63.

The operation of this invention will now be described with reference to the embodiment mentioned above. In FIG. 1, when the engine is operated in a cooled condition, a thermo-switch 16*a* for operating the solenoid valve 16 is turned OFF and an atmosphere opening port 16*b* of the solenoid valve is opened. Atmospheric air flows, therefore, through the pressure delay valve 15 into the diaphragm chamber 10 of the first air switching changing valve 9, which diaphragm chamber 10 is kept at atmospheric pressure. The valve element 11 is, therefore, pushed downward in the drawing and communicates the inlet port 12 with the outlet port 14. Under this condition, secondary air supplied into the first air changing valve 9 from the air pump 8 is discharged from the outlet port 14 into the atmosphere. Therefore, in this condition, secondary air is not supplied into the exhaust passage. The thermo-switch 16*a* for operating the solenoid valve 16 is one of the switches known in the art, which contains means for detecting the temperature of an engine, such as the temperature of engine cooling water, and is turned OFF when the engine is operated in a cooled condition, while is turned ON when the engine is in warming or warmed up operating conditions. It is necessary, however, to set the fixed temperature of the thermo-switch 16*a* at which its turning operation is performed, at a value lower than that of the vacuum switching valve 40 of engine cooling water detection type.

During the time the engine is in a warming operating condition, the intake manifold vacuum is transmitted into the diaphragm chamber 10 of the first air switching valve 9 and, therefore, the valve element 11 is moved upward in the drawing. Therefore, the discharge of secondary air from the outlet port 14 is interrupted, while the secondary air flows out from the outlet port 13 of the first air switching valve 9 into the second air switching valve 20.

During the time engine cooling water 41, shown in FIG. 2, is still at a low temperature, in other words, the engine is in a warming operating condition, the valve element 45 of the vacuum switching valve 40, of engine cooling water detection type, is pushed upward by the spring 48 and communicates the outlet port 46 with the atmospheric air introduction port 49. Therefore, atmospheric air is introduced into the diaphragm chamber 22 of the second air switching valve 20 from the atmospheric air introduction port 48 of the vacuum changing switch 40 through the outlet 46 and the pressure delay valve 30. This causes the valve element 24 to be pushed downward in FIG. 2 by the spring 23 and to communicate the inlet port 21 with the outlet port 25. In this condition, therefore, secondary air is supplied from the outlet port 25 through the secondary air passage 27 to the first air injection port 6, from which secondary air is injected into the exhaust system at the upstream side of the exhaust manifold 2.

In a warming operating condition of the engine, however, if the vacuum pressure in the intake manifold is temporarily and abruptly increased, such as because the transmission gear is shifted or the engine is abruptly decelerated, the intake manifold pressure is transmitted into the diaphragm chamber 51 of the vacuum introduction valve 50 through the solenoid valve 16. This causes the valve element 52 to be moved upward and to communicate the vacuum introduction port 53 with the vacuum pressure outlet port 54, as shown in FIG. 3. Therefore, the vacuum pressure is transmitted from the vacuum introduction port 53 of the vacuum introduction valve 50 into the vacuum outlet port 54 and, then, into the diaphragm chamber 22 of the second air changing valve 20. This causes the valve element 24 to be moved upwardly against the spring 23 and to communicate the inlet port 21 with the outlet port 26. Therefore, secondary air is supplied from the outlet port 26 through the secondary air passage 28 to the second air injection port 7, from which secondary air is injected into the exhaust pipe 3 at the upstream side of the catalytic convertor 5. The time interval during which secondary air is injected from the second air injection port 7 into the exhaust pipe at the upstream side of the convertor 5 is appropriately determined in accordance with the cross-sectional area of an orifice 56 provided in a diaphragm 55 of the vacuum introduction valve 50, shown in FIG. 3.

When the temperature of engine cooling water 41, shown in FIG. 2, is higher than a predetermined value, that is to say, when the engine is in a warmed up operating condition, the solenoid 44 of the vacuum switching valve 40 is excited and the valve element 45 is moved downwardly. The atmospheric air introduction port 48 is closed by the valve element 45, while the vacuum introduction port 47 is communicated with the outlet port 46. Therefore, when the engine is in middle or light load operating conditions, the intake vacuum pressure is transmitted into the diaphragm chamber 22 of the second air switching valve 20 through the vacuum changing switch 40 and the pressure delay valve 30. This causes the valve element 24 to be moved upwardly in FIG. 1 against to the spring 23 and to communicate the inlet port 21 with the outlet port 26. Secondary air is, therefore, supplied from the outlet port 26 through the secondary air passage 28 into the second air injection port 7, from which secondary air is injected into the exhaust pipe 3 at the upstream side of the catalytic convertor 5.

In a warmed operating condition of the engine, however, when the absolute value of intake manifold pressure is decreased, such as because the engine is in high load operating condition, the force of spring 23 overcomes the vacuum pressure transmitted into the diaphragm chamber 22 of the second air switching valve 20, and the valve element 24 is pushed downwardly in the drawing. This causes the inlet port 21 to communicate with the outlet port 25 in order to supply secondary air to the first air injection port 6. However, as the pressure delay valve 30 is provided in the first vacuum passage 32, connecting the vacuum changing switch 40 to the diaphragm chamber 22 of the second air switching valve 20, a vacuum pressure is maintained in the diaphragm chamber 22 for a predetermined time interval. Therefore, even if the absolute value of intake manifold vacuum pressure is abruptly decreased, secondary air is not injected into the exhaust passage at the upstream side of the intake manifold 2 from the first injection port 6, but is injected into the exhaust pipe 3 at the upstream side of the catalytic convertor 5 from the second air injecting port 7 for a predetermined time interval. The absolute value of vacuum pressure in the diaphragm chamber 22 is gradually decreased and, after the predetermined time interval has elapsed, the inlet port 21 communicates with the outlet port 25. This causes secondary air to be injected into the exhaust passage at the upstream side of the intake manifold 2 from the first air injection port 6. It is advantageous that the cross-sectional area of the orifice 30*a* of the pressure delay valve 30 is smaller than that of the orifice 15*a* of the pressure delay valve 15, in order to maintain the diaphragm chamber 22 at a vacuum pressure during a predetermined time interval.

According to the present invention, during the time the engine is in a warming operating condition, even if the air-fuel ratio of the mixture becomes temporarily rich, such as when the transmission gear is shifted or when the engine is abruptly decelerated, secondary air is not supplied at the upstream of the intake manifold 2, but is supplied at the upstream side of the catalytic convertor 5. Therefore, so-called after fire will not occur in an exhaust reactor (not shown) provided in the intake manifold 2, the efficiency of engine operation will be improved and the catalytic convertor 5 is effectively cooled by secondary air.

What we claim is:

1. A secondary air supplying device of an internal combustion engine having an exhaust manifold, and an exhaust passage provided with a catalyzer for purifying exhaust gas which flows therein, said device comprising:

first air injection means having a first air injection port in said exhaust passage upstream of the exhaust manifold of the engine;

second air injection means having a second air injection port in said exhaust passage upstream of said catalyzer;

an air pump for supplying secondary air;

a first vacuum pressure passage;

a second vacuum pressure passage;

a third vacuum pressure passage fluidly connected in parallel with said second vacuum pressure passage;

a first air changing means connected to said air pump and comprising a first pneumatic valve having a first diaphragm chamber connected to the intake manifold through said first vacuum pressure passage;

a second air changing means comprising a second pneumatic valve having a second diaphragm chamber and being adapted to selectively supply the secondary air to one of said first and second air injection ports;

a solenoid valve in said first vacuum pressure passage, said solenoid valve having an atmospheric air introduction port;

a thermo-switch for detecting the temperature of the engine;

said solenoid valve being actuated by said thermo-switch so that when the engine is operated in a cooled condition, atmospheric air is introduced into said first diaphragm chamber so as to release the secondary air into the atmosphere, and when the engine is operated in warming and warmed up conditions, intake manifold vacuum pressure is introduced into said first diaphragm chamber so as to supply the secondary air to said second air changing means;

said second diaphragm chamber being connected to the intake manifold by means of said second vacuum pressure passage and said third vacuum pressure;

a vacuum pressure changing switch in said second vacuum pressure passage, said vacuum pressure changing switch having an atmospheric air introduction port and a sensor for detecting the temperature of engine cooling water, so that when the engine is operated in a warming condition, atmospheric air is transmitted to said second diaphragm chamber so as to supply the secondary air to said first air injection port, and when the engine is operated in a warmed up condition, the intake manifold vacuum pressure is transmitted to said second diaphragm chamber, so as to supply the secondary air to said second air injection port;

a pressure delay valve by which vacuum pressure is maintained in said second diaphragm chamber during a predetermined time interval after the intake manifold vacuum pressure is reduced when the engine is in a high load operating condition, said pressure delay valve being in said second vacuum pressure passage; and a vacuum pressure introduction valve through which vacuum pressure is temporarily transmitted to said second diaphragm chamber, so as to supply the secondary air to said second air injection port when the intake manifold vacuum pressure is abruptly increased, said vacuum pressure introduction valve being in said third vacuum pressure passage.

* * * * *